United States Patent [19]

Murray et al.

[11] Patent Number: 4,564,393

[45] Date of Patent: Jan. 14, 1986

[54] INTRODUCING ONE OR MORE METALS INTO A MELT COMPRISING ALUMINUM

[75] Inventors: Peter Murray; David Slinn, both of Rotherham, England

[73] Assignee: Shieldalloy Corporation, Newfield, N.J.

[21] Appl. No.: 452,112

[22] Filed: Dec. 22, 1982

[30] Foreign Application Priority Data

Dec. 23, 1981 [GB] United Kingdom ..... 8138667

[51] Int. Cl.[4] ..... C22B 21/06

[52] U.S. Cl. ..... 75/256; 75/68 R; 75/93 AC; 75/257

[58] Field of Search ..... 75/68 R, 256, 93 AC, 75/257

[56] References Cited

U.S. PATENT DOCUMENTS

| | | | |
|---|---|---|---|
| 3,104,996 | 9/1963 | Frederick | 75/256 |
| 3,592,637 | 7/1971 | Brown et al. | 420/528 |
| 3,933,476 | 1/1976 | Chopra et al. | 75/68 R |
| 3,935,004 | 1/1976 | Faunce et al. | 75/68 R |

FOREIGN PATENT DOCUMENTS

| | | |
|---|---|---|
| 0751567 | 6/1956 | United Kingdom . |
| 0844546 | 8/1960 | United Kingdom . |
| 1264547 | 2/1972 | United Kingdom . |
| 1463933 | 2/1977 | United Kingdom . |
| 1514313 | 6/1978 | United Kingdom . |

*Primary Examiner*—Melvyn J. Andrews

*Attorney, Agent, or Firm*—L. S. Van Landingham, Jr.

[57] ABSTRACT

An additive is provided which enables metal additions to be made to aluminum melts with good metal recovery and speed of dissolution. The additive includes a mixture comprising:

(a) an aluminum-comprising powder, for example commercially pure aluminum;

(b) a powder of one or more metals or alloys comprising the metal or metals to be introduced, for example manganese, chromium, tungsten, molybdenum, titanium, vanadium, iron, cobalt, copper, niobium, tantalum, zirconium, hafnium and silver; and (c) a flux, for example one or more of potassium aluminum fluoride or potassium cryolite, potassium chloride, potassium fluoride, sodium chloride, sodium fluoride, and sodium carbonate.

In a preferred form, the additive is a compacted tablet of components (a), (b) and (c), in the weight proportions of about 5%, 75% and 20%, respectively. The additive is especially useful in the method of the invention of introducing one or more metals into a melt comprising aluminum. Aluminum alloys are provided which contain a metal or metals introduced by the method of the invention.

40 Claims, 4 Drawing Figures

INTRODUCING ONE OR MORE METALS INTO A MELT COMPRISING ALUMINUM

THE BACKGROUND OF THE INVENTION

1. The Field of the Invention

This invention broadly relates to introducing one or more metals into a melt comprising aluminum. In one of its variants, an additive is provided which enables metal additions to be made to aluminum melts with improved metal recovery and increased speed of dissolution. The invention is also concerned with a method which employs the novel additive of the invention in introducing one or more metals into a melt comprising aluminum. The invention is further concerned with an aluminum alloy prepared by the method of the invention.

2. The Prior Art

When producing aluminum alloys, it is frequently necessary to introduce into a melt of aluminum, or an alloy of aluminum, a metal or alloy which will not itself readily dissolve in the melt. Many types of master alloys and additive mixtures have already been proposed for this purpose, but there remains a need for an additive which, while being economical to manufacture, is also capable of making such additions, both with good metal recoveries and within a short dissolution time. Some examples of prior art additives are found in U.S. Pat. No. 3,592,637.

THE SUMMARY OF THE INVENTION

The present invention provides an additive which enables metal additions to be made to aluminum melts with excellent metal recovery and increased speed of dissolution. The additive includes a mixture comprising an aluminum-comprising powder such as for example, commercially pure aluminum, a powder of one or more metals or alloys comprising the metal or metals to be introduced as described more fully hereinafter, and a flux comprised of one or more components which likewise will be described more fully hereinafter.

The present invention also provides a method of introducing one or more metals into a melt comprising aluminum which employs the above-described additive to thereby achieve improved metal recovery and increased speed of dissolution. The invention additionally provides an aluminum alloy prepared by the method of the invention.

THE BRIEF DESCRIPTION OF THE ACCOMPANYING DRAWINGS

The improved results that are obtained in practicing the present invention are further illustrated by the accompanying drawings, wherein:

FIGS. 1–4 are discussed in greater detail hereinafter in Examples 1–4, respectively.

Figure 1:
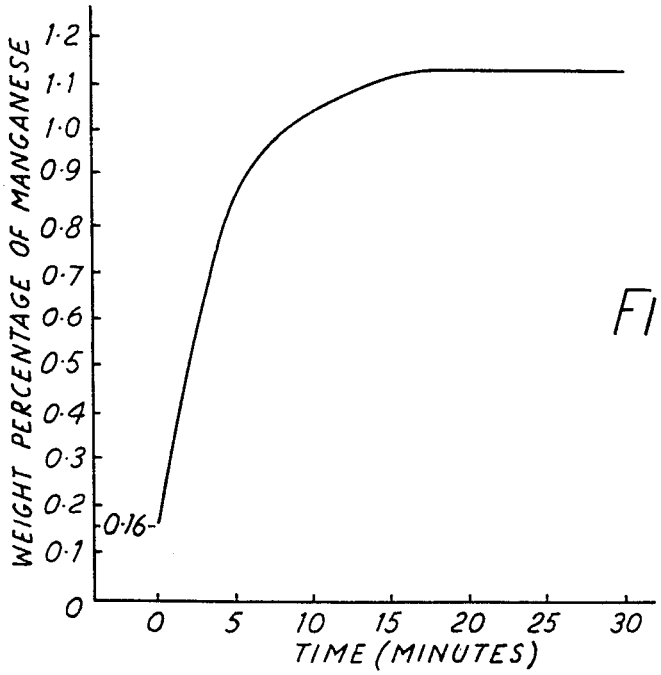
FIG. 1 is a graph prepared from the data obtained in Example 1.

THE DETAILED DESCRIPTION OF THE INVENTION INCLUDING THE PRESENTLY PREFERRED VARIANTS AND EMBODIMENTS THEREOF

According to the present invention, there is provided an additive for introducing one or more metals into a melt comprising aluminum, the additive comprising a mixture comprising:

(a) an aluminum-comprising powder, hereinafter sometimes referred to as the aluminum component;

(b) a powder of one or more metals or alloys comprising the metal or metals to be introduced, hereinafter sometimes referred to as the added metal component; and (c) a flux, which may be comprised of one or more components described more fully hereinafter.

We have found, surprisingly, that the additive in accordance with the invention, which includes both an aluminum component and a flux component, in addition to the added metal component, can when introduced into a melt comprising aluminum, provide a substantially better combination of metal recovery and speed of dissolution than would have been expected on the basis of the properties and amounts of the aluminum and flux components, considering these components separately.

Any aluminum alloy which does not contain objectionable amounts of materials which would have a deleterious effect on the final aluminum alloy which the additive is to be used in producing may be used as the aluminum component, but it is desirable to use as pure a form of aluminum as possible, consistent with cost considerations, and we prefer to use a commercially pure aluminum as component (a). We have discovered it is best that the weight proportion of the aluminum component (a), A, should satisfy: $2\% \leqq A \leqq 10\%$. In addition, the relationship of the aluminum component, A, to the metal or alloy component (b), B, should satisfy the proportion: $9.5 \leqq \%B/\%A \leqq 30$. It is preferred that the relationship of the aluminum component, A, to the metal or alloy component, B, also satisfy the proportion:

$$12 \leqq \%B/\%A \leqq 18.$$

Greater amounts of the aluminum component can be included, but we have discovered that increasing the amount of the aluminum component above this range does not lead to any advantage adequate to compensate for the consequent increased. "diluteness" of the additive as regards the added metal component and/or the loss of performance due to reduction in the flux content. It was a matter of surprise to us the extent of the beneficial effect obtainable with such small amounts of the aluminum component, when in combination with the flux component, in accordance with the invention. We prefer that A should satisfy: $4\% \leqq A \leqq 6\%$. The best results are often obtained when A is about 5%. Additives in accordance with the invention are primarily intended for introducing into aluminum melts metals which have a melting point greater than that of aluminum, for example manganese, chromium, tungsten, molybdenum, titanium, vanadium, iron, cobalt, copper, niobium, tantalum, zirconium, hafnium and silver, and especially manganese, chrominum, titanium, iron and copper. Normally, the added metal component will, for convenience, be one or more such metals in commercially pure form, but if desired, it may be one or more alloys of such metals, provided that use of the alloy(s) will not lead to the introduction of intolerable amounts of deleterious components into the melt.

Where it is desired to introduce a plurality of metals into an aluminum melt, one may introduce one or more of those metals by means of an additive in accordance with the invention, and use other means to introduce one or more other metals. Also, where a plurality of metals are to be introduced by means of an additive in accordance with the invention, those metals may be present in the additive as:

(1) a mixture of powders of the metals;
(2) a powder of an alloy of the metals; or
(3) a mixture of the powders of at least one alloy and at least one metal.

For any of the metals introduced or the metal where only only one is introduced, part of that metal may be introduced into the bath by means other than the additive of the invention, the rest of the metal being introduced by a "trimming" addition, using an additive in accordance with the invention.

We prefer that the weight proportion of component (b), (B), should satisfy: $60\% \leqq B \leqq 90\%$. Satisfying this condition enables the additive to be reasonably concentrated in the added metal component, while at the same time obtaining fast dissolution and high added metal component recovery. We most prefer that B should satisfy: $70\% \leqq B \leqq 80\%$, and even more specifically, B advantageously may be about 75% in many instances.

We have found that, for best results, the weight proportion of the flux component, C, should satisfy $10\% \leqq C \leqq 30\%$ or $10\% \leqq C \leqq 35\%$. Preferably, C is: $15\% \leqq C \leqq 25\%$. Presently preferred fluxes include one, or a mixture of two or more, of the following chemicals: potassium aluminum fluoride or potassium cryolite, potassium chloride, potassium fluoride, sodium chloride, sodium fluoride and sodium carbonate. At C values less than about 10%, the benefits to be obtained by the inclusion of the flux are substantially below their maximum, and with C greater than about 35%, the consequent dilution of the other components in the additive is not adequately compensated for.

Desirably, but not essentially, the flux component should be non-hygroscopic. We have found that when such fluxes are employed, it is generally easier to introduce the additives into aluminum melts, and to maintain them submerged therein. We have also found that similarly good results can be obtained, even where the flux is not non-hygroscopic, provided that one can arrange that the additive is not exposed to moisture for any substantial period of time, for example by enclosing it in a moisture barrier, such as a polythene sheet material, for example, during storage prior to use.

Especially good combinations of (1) quick dissolution and (2) additive metal recovery can be obtained when the flux component comprises potassium aluminum fluoride, and especially when this makes up at least 50% by weight of the flux component. The potassium aluminum fluoride is the potassium analogue of cryolite, and is herein called potassium cryolite. Where the flux is to be substantially non-hygroscopic, the flux component preferably substantially consists of a non-hygroscopic potassium aluminum fluoride. An especially preferred additive in accordance with the invention is one in which the aluminum component is commercially pure aluminum, at least 50% by weight of the flux component is potassium cryolite, and A is about 5%, B is about 75% and C is about 20%. Where this additive will not be adequately protected from moisture prior to its use, we prefer that the flux should substantially consist of potassium cryolite. Particularly preferred forms of the additives described in this paragraph are those in which the added metal component is commercially pure chromium, commercially pure manganese, commercially pure iron, commercially pure titanium, or 90% titanium alloy.

In general, we prefer that the particles of the aluminum component and added metal component from which the additive is formed are of particle size minus 10 mesh or minus 20 mesh (British Standard Screen Scale, i.e., B.S.S.S.), and for some purposes we prefer the particle size to be minus 40 or minus 100 mesh (B.S.S.S.). We have found that the additives are much easier to introduce into, and maintain within, aluminum melts when they are in the form of a body which has been formed by compression of its constituents. Such bodies may be formed by compressing powdered mixtures of components (a), (b) and (c) using, for example, a roll press, or a horizontal hydraulic pelleting machine. The mixed components can also be added to molten aluminum in a loose powder form by enclosure within protective consumable containers or by injection of the powders into the molten aluminum utilizing a carrier gas to transport the additive beneath the surface of the molten aluminum.

The present invention also comprehends a method of introducing one or more metals into a melt comprising aluminum, the method comprising introducing an additive in accordance with the invention into the melt, and permitting or causing the addititve to be substantially uniformly disbursed through the melt. In many cases, the melt into which the additive is introduced will be a commercially pure aluminum, but it may be an alloy of aluminum, for example where an alloying addition has already been made to an aluminum melt. We have found that the recovery of the component B in the melt and the rate of dissolution within the melt is improved if the density of the compacted body is greater than or equal to 4.0 grams per cubic centimeter.

The invention further comprehends an aluminum alloy, whenever containing a metal or metals introduced by a method in accordance with the invention.

In order that the invention may be more fully understood, some embodiments in accordance therewith will now be described in the following Examples. In the foregoing discussion, the Examples, and the claims the percentages are by weight.

EXAMPLE 1

A mixture of the following particulate components was prepared:

75.8% manganese powder (minus 40 mesh B.S.S.S.)
19.2% potassium cryolite
5.0% aluminum powder (minus 80 mesh B.S.S.S.)

This mixture was formed into cylindrical tablets approximately 90 mm in diameter×25 mm thick on a horizontal hydraulic pelleting machine. The tablets had an average manganese content of about 500 g and an average total weight of about 660 g.

An aluminum melt was carried out in a 5 ton capacity Monometer furnace, the charge consisting of aluminum sows and aluminum scrap. After melting and dross removal, the bath temperature was adjusted to 740° C./750° C. and a sample taken for analysis; the manganese content was 0.16%, and the melt weight was 2578 kg.

Tablets of the manganese additive were added through the side door of the furnace into the clean bath of aluminum, the total amount of manganese contained in the tablets being 1% of the melt weight. Surprisingly, there was very little evidence of fuming.

The bath was intermittently rabelled and the bath temperature adjusted as necessary. Samples for analysis for the weight percentage of manganese in the bath were taken progressively. The results are shown in FIG. 1 of the accompanying drawings, from which it can be seen that virtually 100% manganese recovery was achieved, about 16 minutes after addition.

In order to test the homogeneity of the addition, three samples were taken at spaced-apart locations in the bath 21½ minutes after the additive addition. The three manganese contents as thus-measured were identical, within the range of analytical error.

EXAMPLE 2

A mixture of the following particulate components was prepared:

75.8% chromium powder (minus 60 mesh B.S.S.S.)
19.2% potassium cryolite
5.0% aluminum powder (minus 80 mesh B.S.S.S.)

This mixture was formed into cylindrical tablets of the same dimensions as those prepared in Example 1, using the same machine. The tablets had an average chrominum content of about 500 g and an average total weight of about 660 g.

The procedure of Example 1 was repeated to prepare a clean aluminum bath at 740° C./750° C. in the Monometer furnace, and again a sample was taken for base analysis. In this case the melt weight was 3360 kg and the base analysis was:

0.01% chromium
0.25% silicon
0.17% manganese
0.65% iron.

Figure 2:
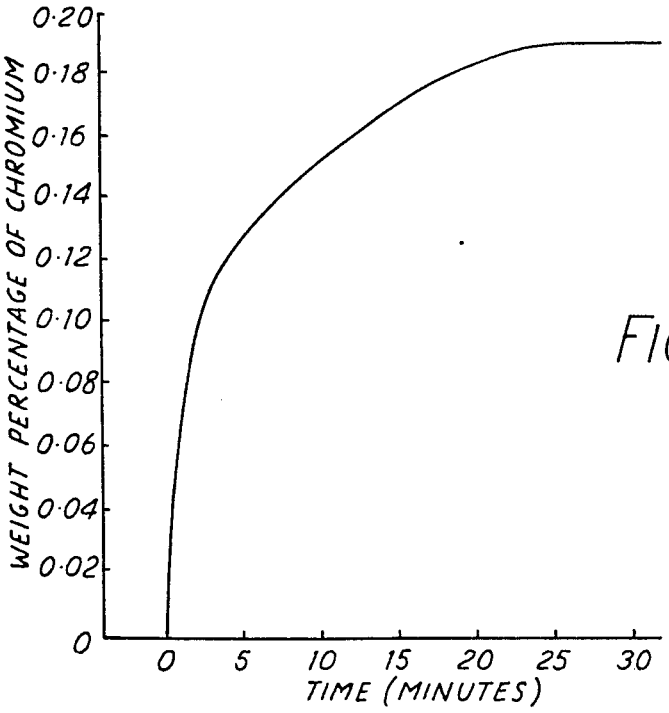
FIG. 2 is a graph prepared from the data obtained in Example 2.

Tablets of the chromium additive were added through the side door into the clean bath of aluminum, the total amount of chromium contained in the tablets being 0.21% of the melt weight. Once again, there was very little evidence of fuming. As in Example 1, the bath was intermittently rabbled and the bath temperature adjusted as necessary, and samples for analysis for the weight percentage of chromium in the bath were taken progressively. The results are shown in FIG. 2 of the drawings, from which it will be seen that virtually 100% chromium recovery was achieved, about 25 minutes after addition. Three samples taken 19 minutes after the additive addition at spaced apart locations in the bath gave identical chromium content measurements.

EXAMPLE 3

A mixture of the following particulate components, all minus 100 mesh, was prepared:

75% chromium containing 3% aluminum
5% aluminum powder
12.5% potassium chloride
4.0% sodium chloride
3.5% potassium cryolite This mixture was formed into pillow-shaped tablets approximately 25.4 mm×14.3 mm on a roll press.

In order to compare the performance of this product in accordance with the invention with two prior art products, three tests were run in the laboratory, under identical conditions, which did not, however, entirely match those existing in commercial practice. In particular, the bath was, of course, much smaller than in commercial practice and this led to rather shorter dissolution times than would normally be obtained in commercial practice. The first prior art product was a commercially available product, which was in briquette form, and which was made up to 75% chromium powder and 25% aluminum powder. The second prior art product was in the form of pillow-shaped tablets made in the same manner as the pillow-shaped tablets described at the beginning of this Example, with the modification that the aluminum powder was replaced by additional flux, the weight proportions of the three flux constituents being unchanged.

Figure 3:
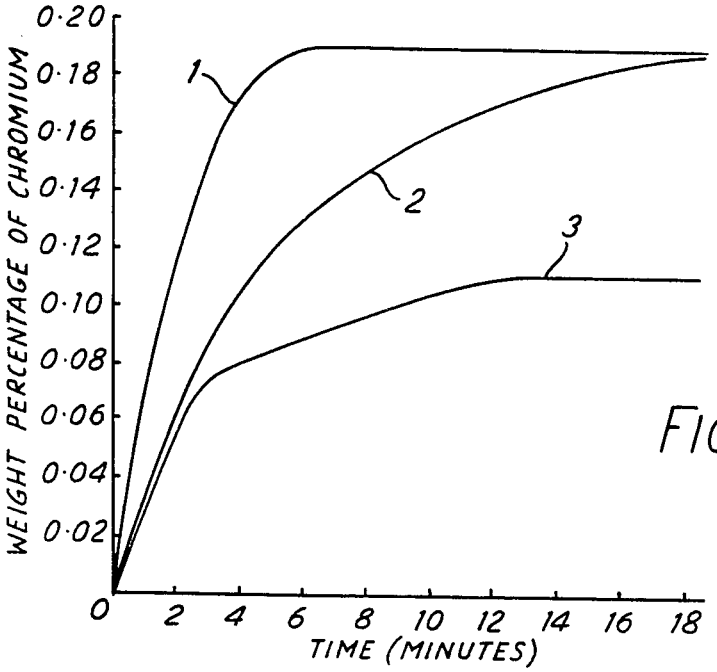
FIG. 3 is a graph prepared from the data obtained in Example 3.

In each test, the additive was introduced into a molten aluminum bath in such an amount that the chromium in the additive was 0.2% of the weight of the bath, and bath samples were removed at regular time intervals for analysis for the weight percentage of chromium in the bath. The results are shown in FIG. 3, wherein Curve 1 relates to the additive in accordance with the invention, Curve 2 relates to the first prior art product (75% chromium/25% aluminum), and Curve 3 relates to the second prior art product (75% chromium/25% flux). As will be seen, substantially the same recovery was obtained in the case of the first prior art product (Curve 2) as in the case of the product in accordance with the invention (Curve 1), but this recovery was achieved in a much shorter time (about 6 minutes) with the product in accordance with the invention than with the prior art additive (about 18 minutes). The overall performance of the second prior art product (Curve 3) was markedly inferior.

EXAMPLE 4

Three further batches of pillow-shaped tablets in accordance with the invention were prepared in the same manner as in Example 3, with the exception that the amount of flux was varied, with corresponding variations in the amount of chromium powder. These additional batches had the following respective percent compositions:

| | | | |
|---|---|---|---|
| chromium (containing 3% aluminum) | 90 | 60 | 50 |
| aluminum powder | 5 | 5 | 5 |
| flux | 5 | 35 | 45 |

In each case, the flux consisted of potassium chloride, sodium chloride and potassium cryolite, in the same weight proportions as in the tablets of Example 3 in accordance with the invention.

Figure 4:
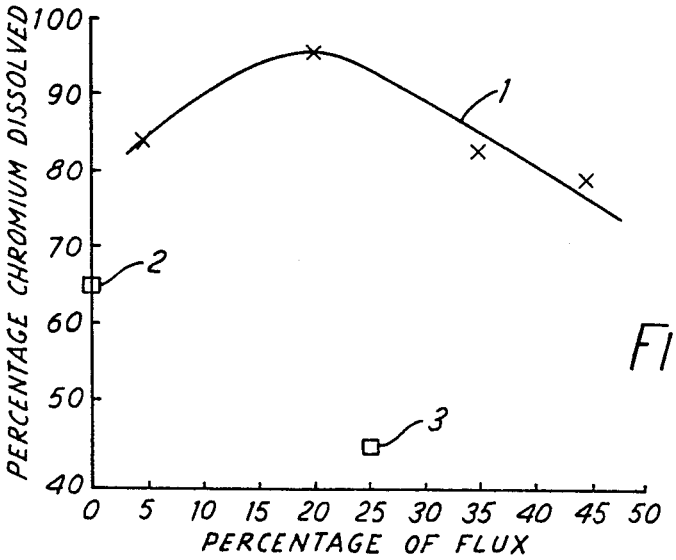
FIG. 4 is a graph prepared from the data obtained in Example 4.

These three batches were tested in the same manner as in Example 3, under the same conditions, and in each case the percentage of the total chromium contained in the additive which had gone into solution in the bath after 6 minutes was noted. The results are shown in FIG. 4, which also shows the corresponding figures relating to the additive in accordance with the invention and the prior art additives tested in Example 3. The figures relating to the additives in accordance with the invention are plotted as Curve 1, and points 2 and 3 respectively show the results obtained with the first and second prior art additives.

EXAMPLE 5

A mixture of the following components was prepared:

75% electrolytic manganese metal

5% aluminum powder
12.5% potassium chloride
4.0% sodium chloride
3.5% potassium cryolite This mixture was formed into briquettes approximately $\frac{7}{8}$ inch by $\frac{1}{2}$ inch. An addition equivalent to 1.23% manganese was made to a 3.6 pound bath of molten aluminum. Samples were taken from the molten bath prior to the addition and at intervals throughout the test after agitation of the bath.

| TIME FROM ADDITION IN MINUTES | ACTUAL ANALYSIS (% Mn DISSOLVED IN BATH) |
|---|---|
| 0 | 0.003 |
| 1 | 1.07 |
| 5 | 1.22 |
| 10 | 1.17 |
| 15 | 1.25 |
| 20 | 1.22 |
| 25 | 1.20 |

More than 97% of the manganese addition was dissolved within five minutes of the initial addition. The overall recovery of over 97% was excellent.

EXAMPLE 6

A mixture of the following components was prepared:

75% iron powder
5% aluminum powder
12.5% potassium chloride
4.0% sodium chloride
3.5% potassium cryolite This mixture was formed into briquettes approximately $\frac{7}{8}$ inch by $\frac{1}{2}$ inch. An addition equivalent to 0.53% iron was made to a 3.4 pound bath of molten aluminum having an iron content of 0.17%. Samples were taken from the bath prior to the addition and at intervals throughout the test after agitation.

| TIME FROM ADDITION IN MINUTES | ACTUAL ANALYSIS (PERCENT IRON DISSOLVED) |
|---|---|
| 0 | 0.17 |
| 1 | 0.55 |
| 5 | 0.65 |
| 10 | 0.67 |
| 15 | 0.69 |
| 20 | 0.69 |
| 25 | 0.67 |

Comparing the aim of the addition (0.70%) against the analysis of the bath, it is evident that both fast dissolution rate and recovery in excess of 95% were achieved.

The potassium aluminum fluoride referred to in the foregoing description as potassium cryolite may be any non-hygroscopic salt material containing potassium, aluminum and fluorine in proportions consistent with the salt being a mixture of $AlF_3$ and KF, and capable of melting at a temperature below that of the bath into which the additive is to be introduced. However, in practice the salt material generally will not be in the form of a simple mixture of $AlF_3$ and KF, at least when in the molten condition when in use; see the KF-$AlF_3$ phase diagram of FIG. 1 of the paper Furnace Brazing OF Aluminium With A Non-Corrosive Flux by W. E. Cooke, T. E. Wright and J. A. Hirschfield, published in 1978 by the Society of Automotive Engineers, Inc., Pennsylvania, U.S.A. as Technical Paper Series 780,300, ISSN 0148-7191. The phase diagram was taken from B. Jansen, Phase And Structure Determination Of New Complex Alkali Aluminium Fluoride", Institute Of Inorganic Chemistry, Norwegian Technical University, Trontheim, 1969.

Preferably, the potassium aluminum fluoride should have as low a melting temperature as possible, and most preferably below about 600° C. For this reason, we prefer that (regarding the potassium cryolite as a mixture of KF and $AlF_3$) the molar percentage of $AlF_3$ should lie between about 45% and 50%. The potassium cryolite employed in the foregoing Examples was obtained from the London and Scandinavian Metallurgical Company Limited, Rotherham, England under the description potassium aluminum fluoride, and had a molar $AlF_3$ percentage falling within this range.

We claim:

1. An additive composition for introducing at least one additive material into a melt comprising aluminum, the additive composition consisting of as essential ingredients an intimate admixture containing the following components:

(a) a metallic aluminum-comprising powder;
(b) a powder of at least one additive metallic material to be introduced into the said melt selected from the group consisting of metallic manganese, chromium, tungsten, molybdenum, titanium, vanadium, iron, cobalt, copper, niobium, tantalum, zirconium, hafnium, silver and alloys thereof; and
(c) a flux component selected from the group consisting of potassium aluminum fluoride (potassium cryolite), potassium chloride, potassium fluoride, sodium chloride, sodium fluoride, sodium carbonate, and admixtures thereof.

2. The additive composition of claim 1 wherein the weight proportion of component (a),A, satisfies: $4\% \leqq A \leqq 6\%$.

3. The additive composition of claim 1 wherein the weight proportion of component (b),B, satisfies: $60\% \leqq B \leqq 90\%$.

4. The additive composition of claim 1 wherein the weight proportion of component (b),B, satisfies: $70\% \leqq B \leqq 80\%$.

5. The additive composition of claim 1 wherein the weight proportion of component (c),C, satisfies: $10\% \leqq C \leqq 35\%$.

6. The additive composition of claim 1 wherein the weight proportion of component (c),C, satisfies: $15\% \leqq C \leqq 25\%$.

7. The additive composition of claim 1 wherein component (a) is a commercially pure aluminum powder.

8. The additive composition of claim 1 wherein component (b) is a powder of at least one additive metallic material to be introduced into the said melt selected from the group consisting of commercially pure metallic manganese, chromium, titanium, iron, copper, and alloys thereof.

9. The additive composition of claim 1 wherein the said additive metallic material is manganese.

10. The additive composition of claim 1 wherein the said additive metallic material is chromium.

11. The additive composition of claim 1 wherein the said additive metallic material is iron.

12. The additive composition of claim 1 wherein the components (a) and (b) have a particle size of minus 10 mesh (British Standard Screen Scale).

13. The additive composition of claim 1 wherein the components (a) and (b) have a particle size of minus 40 mesh (British Standard Screen Scale).

14. The additive composition of claim 1 wherein the components (a) and (b) have a particle size of minus 100 mesh (British Standard Screen Scale).

15. The additive compositions of claim 1 wherein the component (c) comprises potassium aluminum fluoride (potassium cryolite).

16. The additive composition of claim 1 wherein the Component (c) comprises at least one fluxing material selected from the group consisting of non-hygroscopic fluxes, hygroscopic fluxes, and admixtures thereof.

17. The additive composition of claim 1 wherein the weight proportion of component (b), B, satisfies $60\% \leqq B \leqq 90\%$, the weight proportion of component (c), C, satisfies $10\% \leqq C \leqq 35\%$, and the components (a) and (b) have a particle size of minus 10 mesh (British Standard Screen Scale).

18. The additive composition of claim 17 wherein the weight proportion of component (a), A, satisfies $4\% \leqq A \leqq 6\%$, the weight proportion of component (b),B, satisfies $70\% \leqq B \leqq 80\%$, the weight proportion of component (c), C, satisfies $15\% \leqq C \leqq 25\%$, and the components (a) and (b) have a particle size of minus 40 mesh (British Standard Screen Scale).

19. The additive composition of claim 18 wherein the components (a) and (b) have a particle size of minus 100 mesh (British Standard Screen Scale), the said fluxing material comprises potassium aluminum fluoride (potassium cryolite), the said admixture of components (a), (b) and (c) has been formed into briquettes by compression, and the density of said briquettes is at least 4.0 g/cc.

20. The additive composition of claim 19 wherein the said admixture comprises about 5% by weight of component (a), about 75% by weight of component (b) and about 20% by weight of component (c), and the said fluxing material comprises potassium aluminum fluoride (potassium cryolite) having a melting point below 600° C.

21. An additive composition for introducing at least one additive material into a melt comprising aluminum, the additive composition consisting of as essential ingredients an intimate admixture containing the following components:

(a) a metallic aluminum-comprising powder;

(b) a powder of at least one additive metallic material to be introduced into the said melt selected from the group consisting of metallic manganese, chromium, tungsten, molybdenum, titanium, vanadium, iron, cobalt, copper, niobium, tantalum, zirconium, hafnium, silver and alloys thereof; and (c) a flux component consisting of as an essential ingredient at least one fluxing material selected from the group consisting of alkali metal-containing halide fluxes, alkali metal-containing carbonate fluxes, and admixtures thereof; and wherein the weight proportion of component (a), A, in said additive composition satisfies both: $2\% \leqq A \leqq 10\%$ and $9.5 \leqq \%B/\%A \leqq 30$, the weight proportion of component (b),B, satisfies: $60\% \leqq B \leqq 90\%$; and the weight proportion of component (c),C, satisfies: $10\% \leqq C \leqq 35\%$.

22. The additive composition of claim 21 wherein the weight proportion of component (a), A, satisfies $4\% \leqq A \leqq 6\%$, the weight proportion of component (b),B, satisfies $70\% \leqq B \leqq 80\%$, and the weight proportion of component (c), C, satisfies $15\% \leqq C \leqq 25\%$.

23. The additive composition of claim 21 wherein the weight proportion of component (a),A, satisfies: $4\% \leqq A \leqq 6\%$.

24. The additive composition of claim 21 wherein the weight proportion of component (b),B, satisfies: $70\% \leqq B \leqq 80\%$.

25. The additive composition of claim 21 wherein the weight proportion of component (c),C, satisfies: $15\% \leqq C \leqq 25\%$.

26. The additive composition of claim 21 wherein component (a) is a commercially pure aluminum powder.

27. The additive composition of claim 21 wherein component (b) is a powder of at least one additive metallic material to be introduced into the said melt selected from the group consisting of commercially pure metallic manganese, chromium, titanium, iron, copper, and alloys thereof.

28. The additive composition of claim 21 wherein the said additive metallic material is manganese.

29. The additive composition of claim 21 wherein the said additive metallic material is chromium.

30. The additive composition of claim 21 wherein the said additive metallic material is iron.

31. The additive composition of claim 21 wherein the components (a) and (b) have a particle size of minus 10 mesh (British Standard Screen Scale).

32. The additive composition of claim 21 wherein the components (a) and (b) have a particle size of minus 40 mesh (British Standard Screen Scale).

33. The additive composition of claim 21 wherein the components (a) and (b) have a particle size of minus 100 mesh (British Standard Screen Scale).

34. The additive composition of claim 21 wherein the component (c) comprises at least one fluxing material selected from the group consisting of potassium aluminum fluoride (potassium cryolite), potassium chloride, potassium fluoride, sodium chloride, sodium fluoride, sodium carbonate, and admixtures thereof.

35. The additive composition of claim 21 wherein the component (c) comprises potassium aluminum fluoride (potassium cryolite).

36. The additive composition of claim 21 wherein the Component (c) comprises at least one fluxing material selected from the group consisting of non-hygroscopic fluxes, hygroscopic fluxes, and admixtures thereof.

37. The additive composition of claim 22 wherein the components (a) and (b) have a particle size of minus 10 mesh (British Standard Screen Scale).

38. The additive composition of claim 22 wherein the components (a) and (b) have a particle size of minus 40 mesh (British Standard Screen Scale).

39. The additive composition of claim 38 wherein the components (a) and (b) have a particle size of minus 100 mesh (British Standard Screen Scale), the said fluxing material comprises potassium aluminum fluoride (potassium cryolite), the said admixture of components (a), (b) and (c) has been formed into briquettes by compression, and the density of said briquettes is at least 4.0 g/cc.

40. The additive composition of claim 39 wherein the said admixture comprises about 5% by weight of component (a), about 75% by weight of component (b) and about 20% by weight of component (c), and the said fluxing material comprises potassium aluminum fluoride (potassium cryolite) having a melting point below 600° C.

* * * * *